US009087434B2

(12) United States Patent
Schwerdling

(10) Patent No.: US 9,087,434 B2
(45) Date of Patent: Jul. 21, 2015

(54) GAMING MACHINE AND METHOD WITH BONUS REEL FEATURES

(75) Inventor: Dirk Schwerdling, Kastellaun (DE)

(73) Assignee: Novomatic AG, Gumpoldskirchen (AT)

( * ) Notice: Subject to any disclaimer, the term of this patent is extended or adjusted under 35 U.S.C. 154(b) by 526 days.

(21) Appl. No.: 12/943,175

(22) Filed: Nov. 10, 2010

(65) Prior Publication Data

US 2012/0115565 A1 May 10, 2012

(51) Int. Cl.
*A63F 9/00* (2006.01)
*G07F 17/32* (2006.01)

(52) U.S. Cl.
CPC ..... *G07F 17/3267* (2013.01)

(58) Field of Classification Search
CPC ..... G07F 17/3267
See application file for complete search history.

(56) References Cited

U.S. PATENT DOCUMENTS

| | | | | |
|---|---|---|---|---|
| 6,261,178 | B1 | 7/2001 | Bennett | |
| 6,612,574 | B1 * | 9/2003 | Cole et al. | 273/138.1 |
| 6,652,378 | B2 * | 11/2003 | Cannon et al. | 463/20 |
| 7,727,069 | B1 * | 6/2010 | Nelson | 463/31 |
| 7,771,266 | B2 * | 8/2010 | Gerrard et al. | 463/20 |
| 7,780,519 | B2 * | 8/2010 | Gomez et al. | 463/25 |
| 8,109,823 | B2 * | 2/2012 | Aoki | 463/20 |
| 8,262,456 | B2 * | 9/2012 | Englman et al. | 463/20 |
| 2004/0102243 | A1 * | 5/2004 | Olsen | 463/25 |
| 2004/0102244 | A1 * | 5/2004 | Kryuchkov et al. | 463/32 |
| 2005/0026677 | A1 * | 2/2005 | Roukis | 463/20 |
| 2005/0159208 | A1 * | 7/2005 | Pacey | 463/20 |
| 2005/0215311 | A1 * | 9/2005 | Hornik et al. | 463/20 |
| 2006/0066051 | A1 * | 3/2006 | Nicely | 273/292 |
| 2006/0068892 | A1 * | 3/2006 | Gomez et al. | 463/20 |
| 2006/0189378 | A1 * | 8/2006 | Aoki | 463/20 |
| 2006/0264254 | A1 * | 11/2006 | Aoki | 463/20 |
| 2007/0111782 | A1 * | 5/2007 | Adams et al. | 463/17 |
| 2008/0058076 | A1 * | 3/2008 | Kojima | 463/20 |
| 2008/0090636 | A1 * | 4/2008 | Lathrop | 463/20 |
| 2008/0125209 | A1 * | 5/2008 | Pacey et al. | 463/20 |
| 2008/0171589 | A1 * | 7/2008 | Nelson | 463/20 |
| 2008/0176636 | A1 * | 7/2008 | Nelson | 463/20 |
| 2008/0254855 | A1 * | 10/2008 | Kojima | 463/20 |
| 2008/0274788 | A1 * | 11/2008 | Wilson | 463/20 |
| 2008/0287178 | A1 * | 11/2008 | Berman et al. | 463/20 |
| 2009/0088242 | A1 * | 4/2009 | Richardson | 463/25 |
| 2009/0131145 | A1 * | 5/2009 | Aoki et al. | 463/20 |
| 2010/0029367 | A1 * | 2/2010 | Englman et al. | 463/20 |
| 2010/0190542 | A1 * | 7/2010 | Mizue | 463/20 |
| 2010/0210345 | A1 * | 8/2010 | Berman et al. | 463/20 |

FOREIGN PATENT DOCUMENTS

EP 1522974 B1 11/2009

* cited by examiner

*Primary Examiner* — Seng H Lim
(74) *Attorney, Agent, or Firm* — Kevin H. Fortin

(57) ABSTRACT

A gaming machine adapted for slot machine play and poker-type games includes a housing, an interface supported by the housing, a set of primary reels and a bonus reel. The primary reels share a common axis and the bonus reel has an axis generally perpendicular to the axis of the bonus reels. This spatial relationship between the bonus reel and the primary reels defines at least one payline between the primary reels and the bonus reel.

15 Claims, 6 Drawing Sheets

GAMING MACHINE AND METHOD WITH BONUS REEL FEATURES

FIELD OF THE INVENTION

The invention pertains to gaming machines and particularly to casino gaming machines including slot machines.

BACKGROUND OF THE INVENTION

In the gaming machine industry, there is a continuing need for gaming machine manufacturers to produce new types of games, or enhancements to existing games, which will attract frequent play by enhancing the entertainment value and excitement associated with the game.

U.S. Pat. No. 6,261,178 to Bennett describes the need for providing gaming enthusiasts with new and interesting gaming machines. One goal of the Bennett machine is to keep gaming a enthusiasts' interest. The Bennett machine has spinning reels with graphical values and pre-determined paylines linking the values. When the reels stop, the paylines determine the payouts according to values in proximity with the paylines. The device in the Bennett patent particularly describes a way that paylines work in a 3×5 display grid. There are nine possible predefined payline arrangements mapped across the grid to keep the gaming enthusiast's interest.

U.S. Pat. No. 6,590,92 to Rothkranz, and corresponding European Patent No. EP1522974B1, describes a slot machine have two sets of reels in a grid to generate values used to determine payouts. One set of reels spins in one plane (actually or virtually) and the other set of reels spins in a plan perpendicular to the first set of reels. An indicator translates, or circles, to determine the bonus payout of one set of reels by using a pointer, for example, and the other set uses a traditional payline. This arrangement increases the complexity of the payout opportunities for the gaming enthusiast by providing a bonus. The bonus may include game credits.

The gaming industry is competitive and ever-evolving. Although many games continue to entertain gaming enthusiasts, there is still an unmet need for better and more interesting games.

SUMMARY OF THE INVENTION

A gaming machine adapted for slot machine play and poker-type games includes a housing, an interface supported by the housing, a set of primary reels and a bonus reel. The primary reels share a common axis and the bonus reel has an axis generally perpendicular to the axis of the bonus reels. This spatial relationship between the bonus reel and the primary reels defines a payline between the primary reels and the bonus reel.

The primary reels having a plurality of symbols characteristic of a card game and the primary reels independently rotate about the common axis to display a matrix of symbols. The bonus reel is positioned in the interface and has an axis generally perpendicular to, and laterally offset from, the common axis of the primary reels. The bonus reel displays a plurality of values so that a payline being defined between the bonus reel and each primary reel.

The primary reels form a first matrix of n rows and m columns, and the bonus reel forms second matrix of one (1) row and m columns. The interface may be unitary or include separate display devices. A computer controls images displayed randomly at the interface, the game controller determines a win-signal when a predetermined combination of symbols is displayed in a pre-defined arrangement, e.g. on a payline.

The second matrix displays a plurality of bonus values in a single row oriented with respect to the first array. Each column of the second matrix correlates to one of the columns of the first matrix to define a payline. The game controller is adapted for controlling the bonus values displayed in the second array. A bonus-win determination calculation is made by the computer for checking for each column whether a trigger symbol is shown at the column of the first array to determine a bonus-win-signal.

According to one aspect of the invention the values are represented in each column of the primary reel by an integer value indicating a number of free games and wherein the bonus-win-signal is a mathematical sum of the respective integer value of each column of the second matrix in case a trigger symbol is shown at the related column of the first matrix.

Initiation of operation of the bonus reel and the primary reel may be performed automatically within the spin action of a single game spin.

According to another aspect of the invention a video displays may be used to simulate spinning reels wherein matrices of pseudo spinning wheels such as a 4×5 matrix of reels may be used, i.e. five main reels, each of them to show three or four symbols in a stop position.

DETAILED DESCRIPTION

Figure 1:
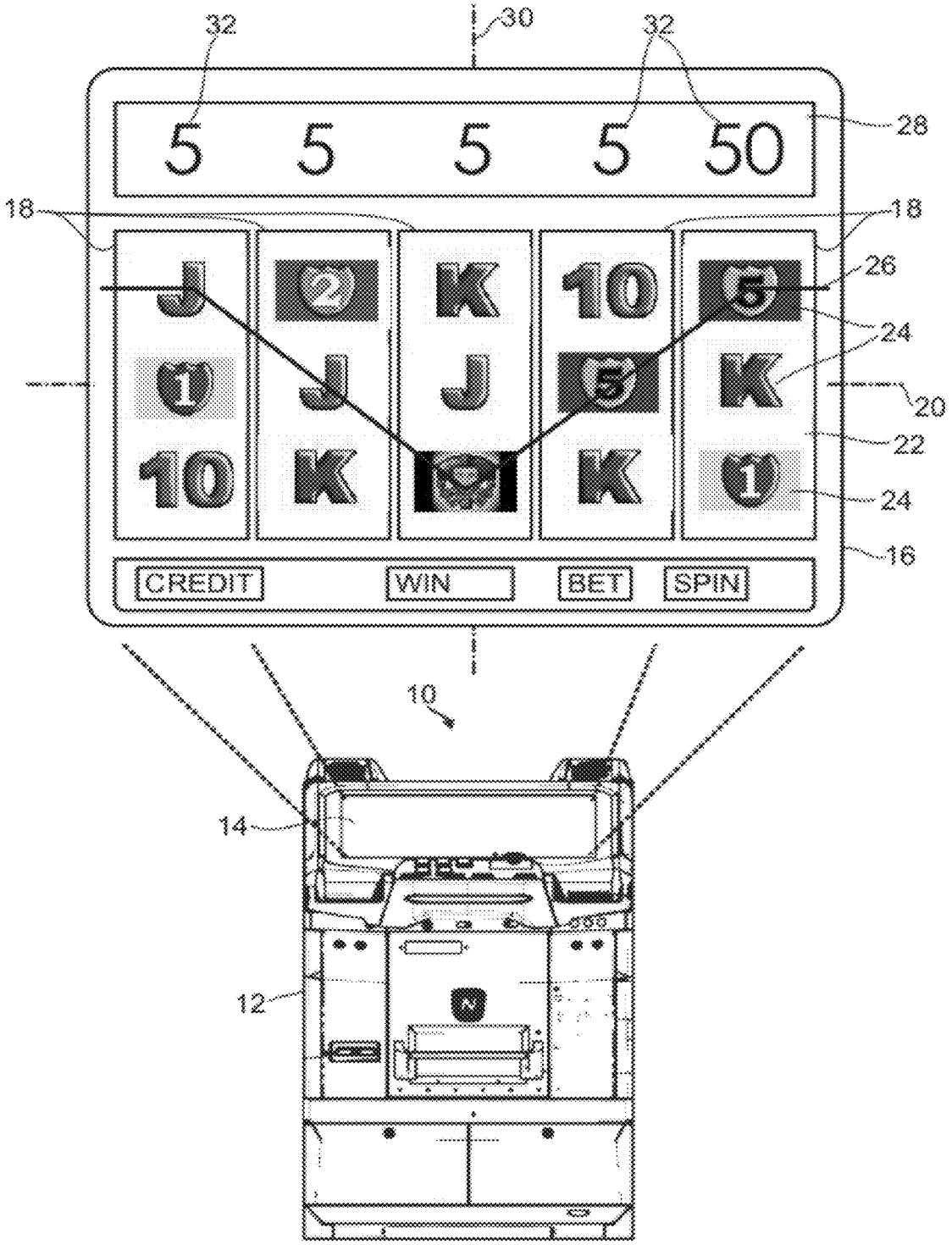
FIG. 1 is a front view of a gaming machine having an interface in an exploded view.

FIG. 1 shows a gaming machine 10. The gaming machine 10 includes a housing 12 with a display area 14. The gaming machine 10 is preferably a slot machine. Slot machine is broadly construed as any gaming machine that is capable of enabling a player to play for entertainment with a probability of a payout.

The display area 14 holds an interface 16, which is supported by the housing 12. The interface 16 faces a user, who may be standing or sitting in proximity to the machine 10.

In one embodiment of the invention, the interface 16 includes a digital display that is angled with respect to the floor to face a user. In another embodiment of the invention, the interface 16 includes a mechanical display that is likewise angled to face a user. It can be appreciated that hybrid arrangements having both digital and mechanical components are contemplated herein and the angle of the interface is adapted to face a user depending on, among other things, the height of the machine 10.

The interface 16 preferably includes a set of five primary reels 18 sharing a common axis 20. In one embodiment of the invention, the reels 18 are physical objects, for example rotatable discs having a display surface 22 for displaying symbols. In another embodiment the reels 18 are electronic images, being electronically represented as virtual rotatable discs having an edge with a display surface 22.

The display surface of each reel 18 has a plurality of symbols 24. In one aspect of the invention, the symbols 24 include playing card values, such as King, Jack, Queen, Joker and various numerical card values. The symbols 24 may also include any other symbols that create interest to a player. The symbols 24 can include digital images, or video-streamed images, or a combination of thereof. Such digital images, or video streamed images, or any combination thereof, may be displayed in the embodiment using physical reels, and in the embodiment using an electronically presented reels. Video streamed images enable the symbols 34 to yield an evolving appearance.

The primary reels 18 each independently rotate about the axis 20, which is common to the primary reels 18. When rotation stops in a random manner within a predefined period a player can verify the symbols 24 presented on a portion of each reel 18 and the determination of the result of game play is performed by the machine.

A payline 26 is displayed overlying the reels showing a relationship between symbols, in this case yielding a pair and three of a kind in accordance with the rules of common poker play. A pair of Jacks is denoted by the symbols "J", a Joker denoted by a face image, and a pair of fives denoted by the symbols "5". According to another embodiment, the win determination of the payline 26 is based on left to right scheme where just the first left symbol followed by at least one straight subsequent equal symbol on the payline are being determined as a win. Paylines can be horizontal, diagonal, or both horizontal and diagonal as shown. Paylines typically indicate whether a payout is forthcoming. The present invention can be adapted to any of a variety of common slot machine games, but is particularly useful with regard to slot machine with poker-style play.

In one embodiment the payline 26 and other pre-determined paylines are etched or scribed on the interface 16, or digitally displayed thereon. In another embodiment, the payline 26 or other pre-determined paylines are inherent by alignment of the symbols 24 on the interface 16, but not visible. In yet another embodiment, the payline 26 is selectively displayed when the payline 26 yields a payout. In yet another embodiment, paylines are indicated by the display area 14 surrounding the interface 16. It can be appreciated than any combination of payline indicia described in this paragraph can be used. It can also be appreciated that the payline can be a line, lines, or a defined region surrounding symbols or values indicating a payout or bonus. The defined region may be illuminated.

The interface 16 includes a bonus reel 28. The bonus reel 28 is an electronic image that virtually rotates about an axis 30. The axis 30 is generally perpendicular to the axis 20, and offset from the axis 20. The bonus reel 28 displays a plurality of values 32. In accordance with one aspect of the invention, the bonus reel 20 is a single reel and the values 32 are integer values displayed in a horizontal row.

The bonus reel 28 is aligned vertically above the set of primary reels 18 on the interface 16, so that the values 32 of the bonus reel 28 are each aligned to a corresponding primary reel 18. Alignment of the values directly above a corresponding primary reel 18 defines an inherent payline between each value 32 and the corresponding primary reel 18, when a payout is indicated by pre-determined game rules. The payline is inherent by virtue of the spatial relationship between the primary reels 18 and the bonus reel 28.

The term "substantially perpendicular" in this context may mean extending a right angle with tolerance of +/−30 degrees and capable of being laterally offset.

Figure 2:
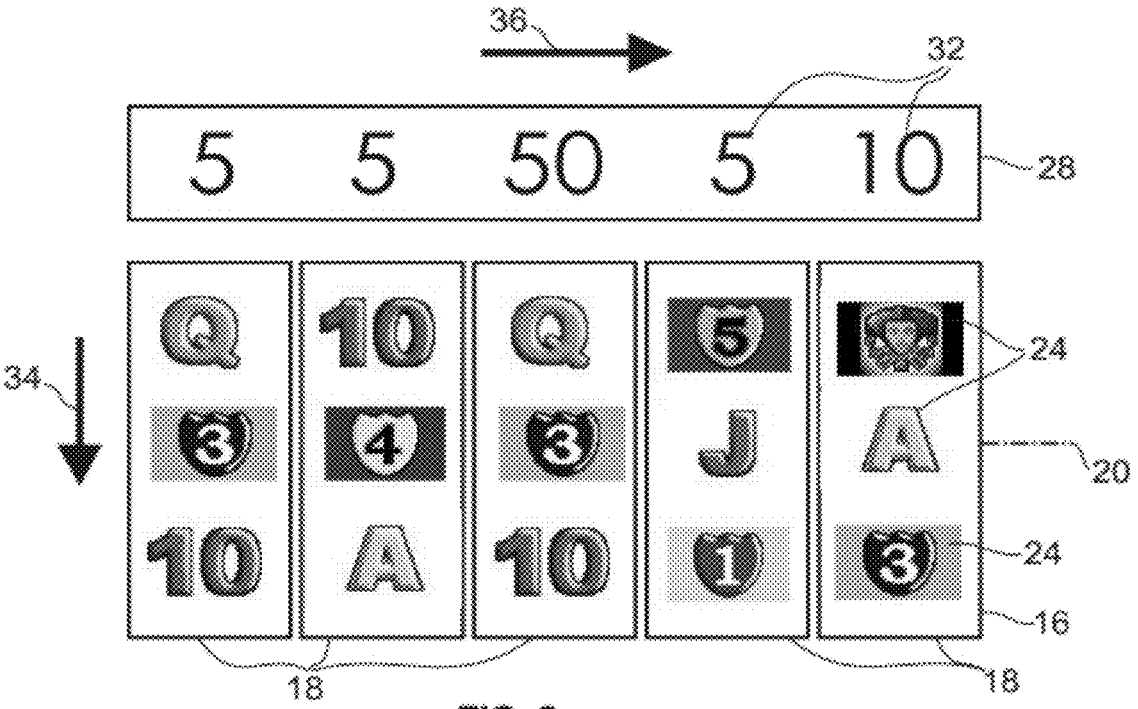
FIG. 2 is a front view of an interface.

FIG. 2 shows of the gaming machine interface 16 in operation. The reels 18 and 28 spin and then stop in a random position. The set of primary reels 18 rotate in the direction of the arrow 34. Since each reel 18 spins independently, the symbols 24 change with each spin. The bonus reel 28 spins in the direction of the arrow 36, and stops in a random position. The values 32 position change with each spin. The stopping of the reels 18 may be consecutively from left to right followed by the bonus reel 28 as the last.

Figure 3:
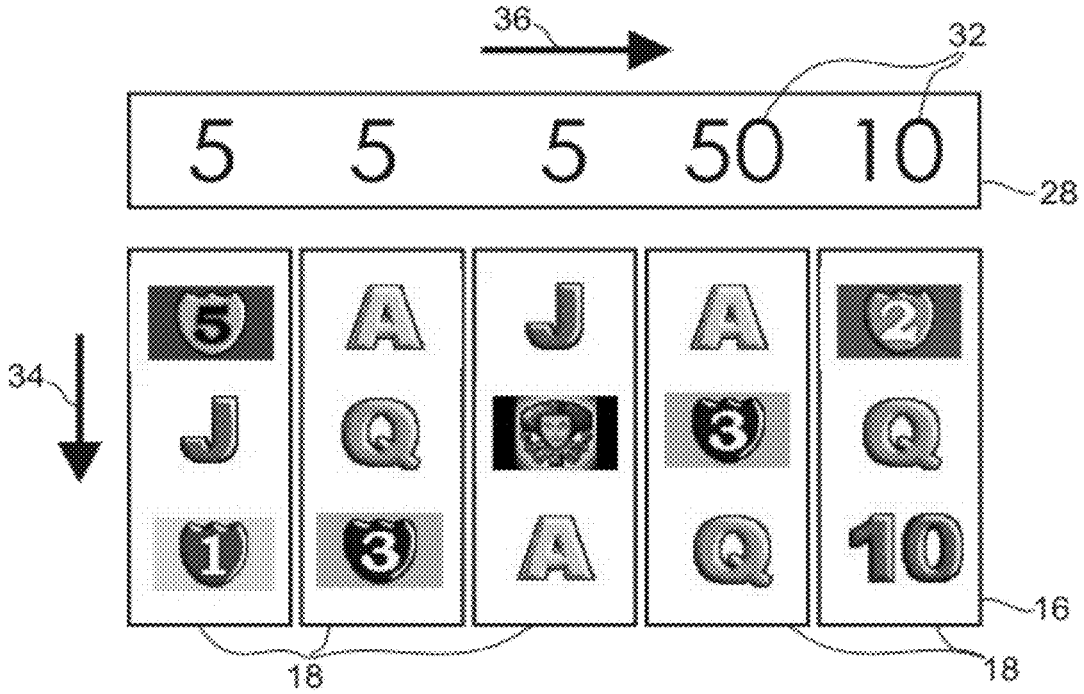
FIG. 3 is a front view of an interface.

FIG. 3 shows another spin position of the primary reels 18 and of the bonus reel 28. Ideally the bonus reel 28 would have only one row of values 32, however, it is contemplated herein that a stack of bonus reels 28 can be adapted to share a common axis and spin independently.

The interface 16 is shown as unitary display; however, the interface 16 can comprise two or more separate displays. Additionally, in accordance with an embodiment of the invention having electronic display capabilities, the primary set of reels 18 and the bonus reel 28 each include matrixes.

The primary reel includes a primary matrix that has n rows and x columns, the bonus reel includes a bonus matrix having one row and x columns. As shown, the primary matrix has three rows and five columns. The bonus matrix has one row and five columns. Both matrixes are aligned relative to each other. In particular, a payline is defined between the columns of the bonus matrix and the primary matrix.

The term matrix means a rectangular array of numbers, algebraic symbols, or mathematical functions, esp. when such arrays are added and multiplied according to certain rules.

Figure 4:
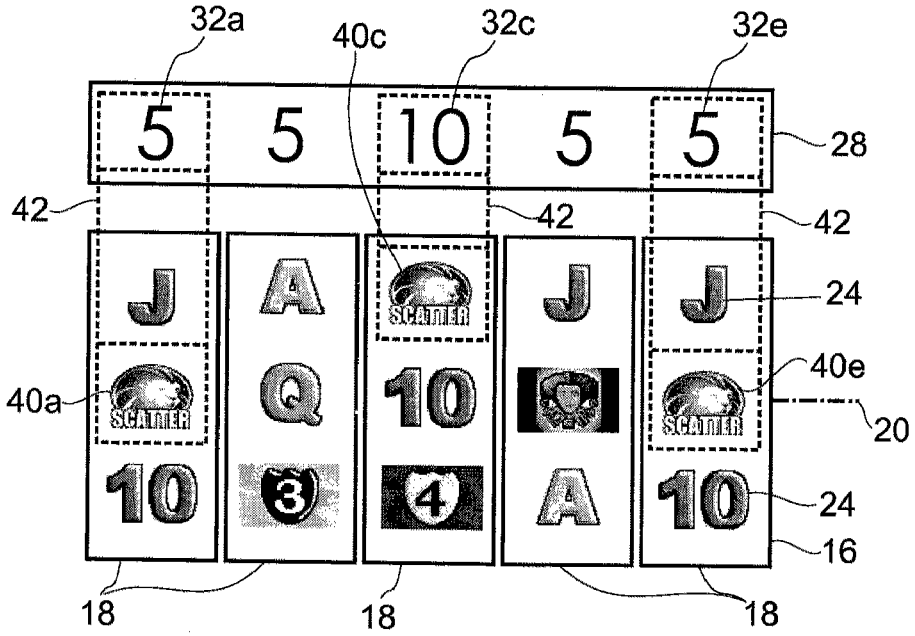
FIG. 4 is a front view of an interface.
Figure 5:
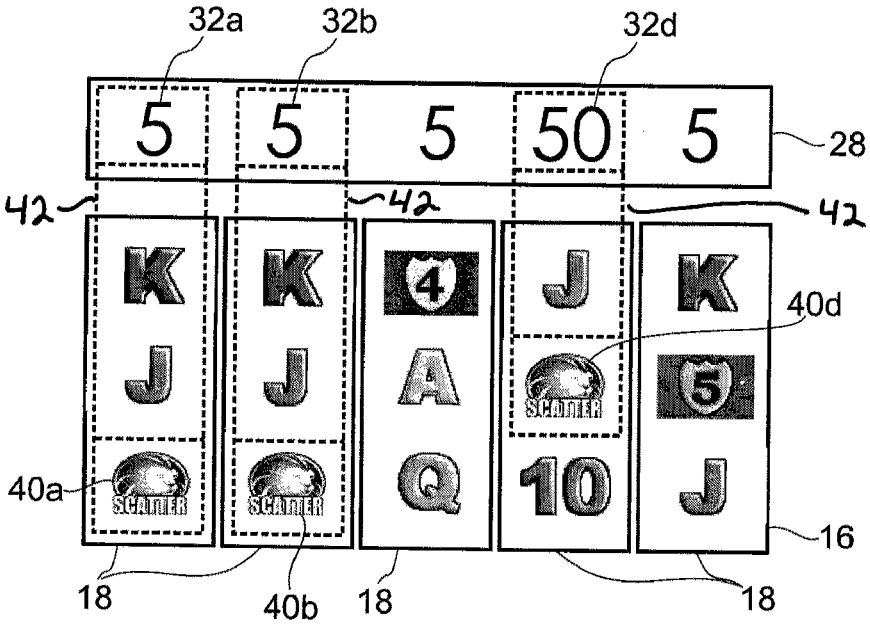
FIG. 5 is a front view of an interface.

FIG. 4 and FIG. 5 show a variation of the invention with a trigger symbol, particularly the "scatter" symbol 40 presented on the primary reels 18. The scatter symbol 40 is a feature, in addition to the poker play, that yields another level of gaming experience. Particularly, the appearance of the scatter symbol 40 indicates that the player wins a bonus, depending on the position of the scatter symbol 40 in the 3×5 matrix. The bonus, in this case, is at least one free game. The number of free games is indicated by the corresponding value 32 of the bonus reel 28 corresponding to the reel 18 displaying the scatter symbol 40. The corresponding value 32 of the bonus reel 28 in this case is located directly above the reel 18 having the scatter symbol 40. This defines a payline 42 from the scatter symbol 40 vertically upwards to the bonus reel 28 value 32.

In FIG. 4 the left most scatter symbol 40*a* lies directly below a bonus value 32*a* having the integer "5", thus creating a vertical payline 42*a* between the value "5" and the scatter symbol 40*a*. Likewise the scatter symbol 40*c* in the center reel 18, lies directly below the value 32*c* having the integer "10", thus creating a vertical payline 42*c* between the integer "10" and the corresponding scatter symbol 40*c*. Likewise the right most scatter symbol 40*e* lies directly below a bonus value 32*e* having the integer "5", thus creating a vertical payline 42*e* between the value "5" and the scatter symbol 40*e*. In game play each payline would yield a bonus value equal to the corresponding integer in the respective payline 42. The sum of the paylines 42, in this representation, is the sum of the integer value 32*a*, 32*c* and 32*e* which is 5+10+5=20. In accordance with game play rules, the paylines 42 yield a sum bonus of "20". This bonus is preferably the number of free games being paid out to a player.

A payline 42, in accordance with one aspect of the present invention is a visible manifestation of the relationship of the payline elements. In this case, the elements are symbols 24 and values 32. The payline in another aspect of the invention is inherent, such as an invisible line indicated by the spatial relationship between the symbols 24 and values 32. Particularly, the generally vertical alignment of the values 32 of the bonus reel 28 and the symbols 24 of the corresponding primary reel 18 defines the inherent payline 28.

Although vertical alignment is described herein, there are variations in the payline angle contemplated by the present invention. For example, a generally perpendicular payline, having an angle of nearly 90 degrees is contemplated herein. The term "generally perpendicular" includes an axial alignment between the primary reels and the bonus reel of 90 degrees +/−15 degrees in one embodiment of the invention.

FIG. 5 shows the result of spinning the primary reels 18 and the bonus reel 28. Again, paylines 42 are shown. The sum of the values 5+5+50=60 free games for the player because each of these values are in a vertical payline 42 corresponding to a scatter symbol 40.

Although a scatter symbol 40 is depicted herein, any symbol can be used to define the payline 42. For example, a symbol depicting a card such as a King, Ace or Joker can be used, depending on the character of the game displayed. Further, where there are two equal values depicted by a single reel 18, the bonus effect of the bonus value along the corresponding payline may yield additional bonuses.

In a preferred embodiment of the invention, there are five primary reels 18 and a single bonus reel 28, yielding a primary reel 18 matrix of 3×5 symbols and a bonus reel 28 matrix of 1×5 values. The number of symbols 18 and the number of values 28 are equal along a horizontal plane.

Figure 6:
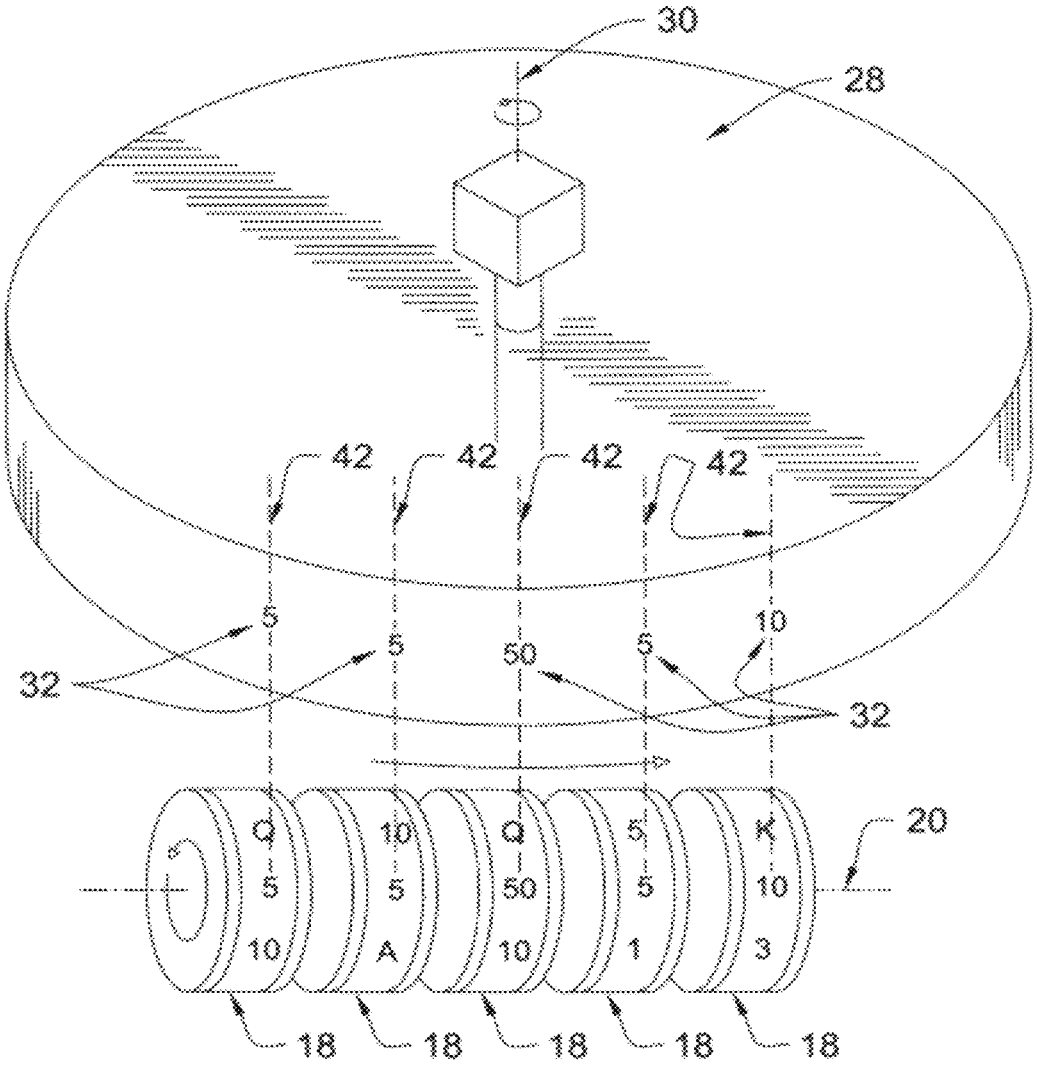
FIG. 6 is an isometric view of a bonus reel and a primary set of reels positioned with respect to each other in accordance with the present invention.

FIG. 6 shows a bonus reel 28 positioned directly above a primary set of reels 18. The bonus reel 28 rotates around the axis 30 and the primary reels 18 rotate around the axis 20. The axis 30 is laterally offset from the axis 20. The bonus reel 28 rotates in a plane generally perpendicular to a plane of rotation of the primary reels 18.

The primary reels 18 align with the values 32 stop position displayed on the bonus reel 28. Particularly each displayed value 32 is positioned directly above a corresponding reel 18.

Paylines 42 are defined between each displayed value 32 and a corresponding reel 18. The paylines 42 are shown in hidden lines because the positioning of the values 15 directly above each corresponding reel 18 result in the paylines being inherent, or obvious to a player so that the inherent paylines obviate the need for actual paylines being displayed.

Figure 7:
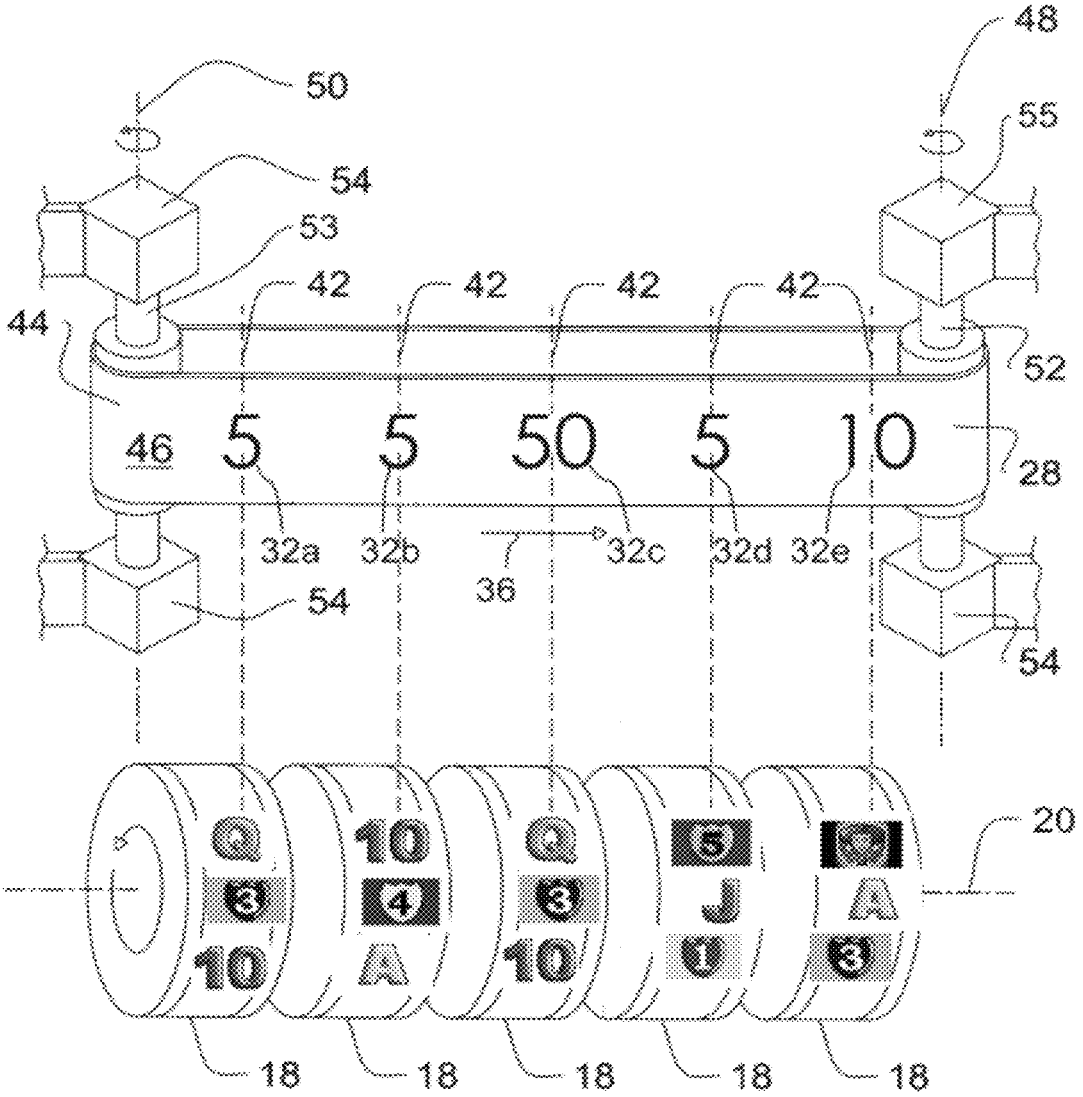
FIG. 7 is an isometric view of a bonus reel and a primary set of reels positioned with respect to each other in accordance with the present invention.

FIG. 7 shows a bonus reel 28 and primary reels 18. The bonus reel 28 includes a belt 44 having a display surface 46. The values 32 are displayed on the display surface 46. The belt 44 is flexible to mount on two spindles 52, 53. The spindle 52 rotates, driven by a motor 55, about the axis 48 and the spindle 52 rotates about the axis 50 during operation. The spindles 52, 53 each include mounting support 54 for mounting the belt 44 within the housing. The motor drives the spindles 52 to spin on one direction. The belt 44 spins and may then stop in a random position and align each value 32 directly above a corresponding reel 18 to facilitate game play.

Figure 8:
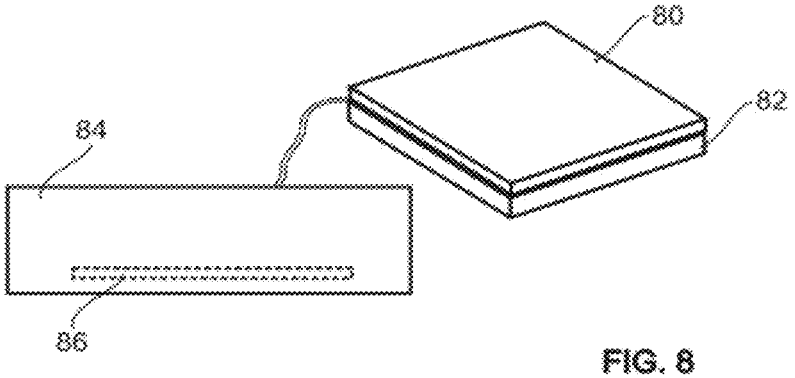
FIG. 8 is a perspective view of a computer and a display interface in accordance with the present invention.

FIG. 8 shows the computer 84, which mounts in the housing and connects with a display interface 80 that may include a touch-screen. The computer includes a main board 86 having a controller, memory connected to the main board for storing software, software stored in the memory for operating the interface 80, software drivers, and a main processor.

Figure 9:
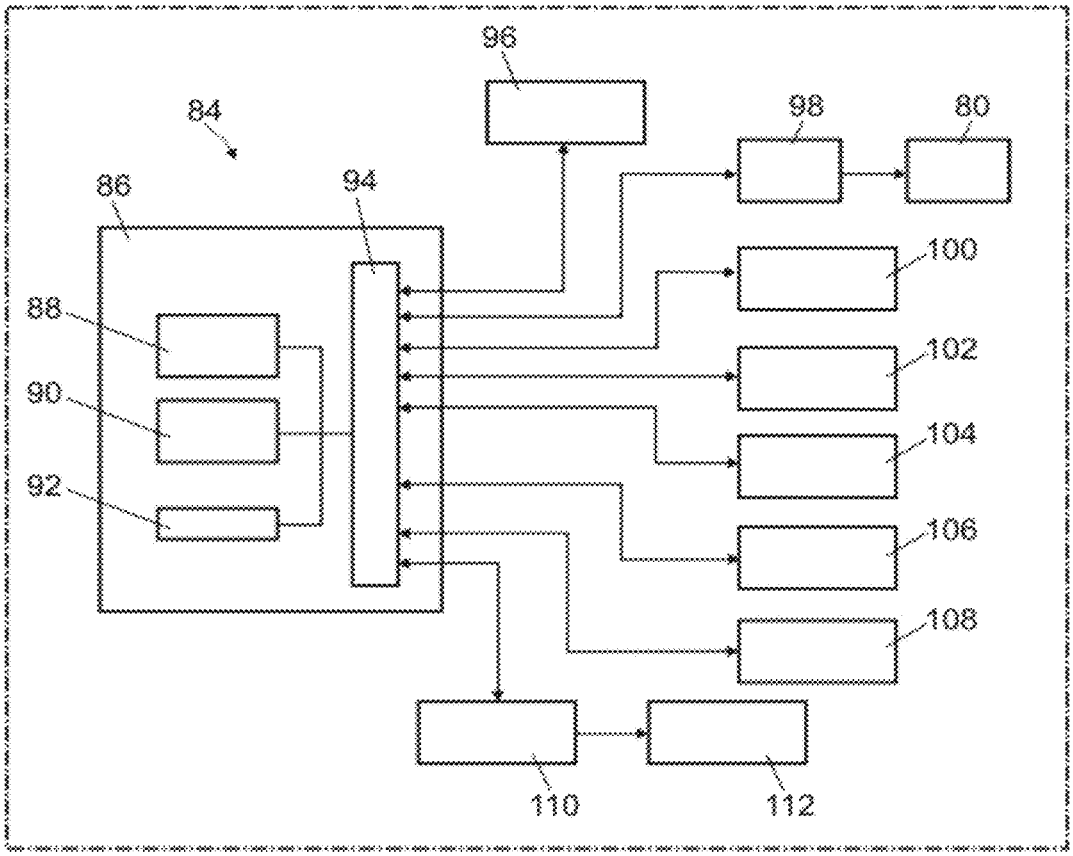
FIG. 9 is a system diagram in accordance with the present invention.

FIG. 9 shows a system diagram of the computer 84. The main board 86 includes program memory 88 being a computer readable medium, a main processor 90 and RAM 92 connected in operative communication. The computer 84 has an input output I/O controller 94. The I/O controller 94 communicates with a control panel 96, a display interface driver 98, a display unit 100, a coin acceptor 102, a bill acceptor 104, a card reader 106, a ticket reader/printer 108, and a sound circuit 110. The sound circuit 110 is in operative communication with speakers 112.

The coin acceptor 102 and the bill acceptor 104 accept currency and communicate the amount accepted to the I/O controller 94. The card reader 106 reads credit cards, debit cards, gift cards or other card having electronic indicia of monetary value.

The ticket reader 108 prints tickets and receipts revealing the winnings of a player, or other financial outcome. The ticket reader 108 also receives tickets having indicia of monetary value.

The sound circuit 110 is configured to provide an acoustic-based interface for the user. Each movement or action by a user may result in a particular sound, or instruction being generated by the computer 84. The speakers 112 communicate the sounds to the user.

Unless the context requires otherwise, throughout the specification and claims which follow, the word "comprise" and variations thereof, such as, "comprises" and "comprising" are to be construed in an open, inclusive sense, that is, as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in this specification and the appended claims, the singular forms "a," "an," and the include plural referents unless the context clearly dictates otherwise. It should also be noted that the term or is generally employed in its sense including "and/or" unless the context clearly dictates otherwise.

The headings and the Abstract provided herein are for convenience only and do not interpret the scope or meaning of the embodiments.

It will be readily apparent to one of ordinary skill in the art that the various processes described herein may be implemented by, e.g., appropriately programmed general purpose computers, special purpose computers and computing devices. Typically a processor e.g., one or more microprocessors, one or more microcontrollers, one or more digital signal processors will receive instructions e.g., from a memory or like device, and execute those instructions, thereby performing one or more processes defined by those instructions.

A "processor" means one or more microprocessors, central processing units CPUs, computing devices, microcontrollers, digital signal processors, or like devices or any combination thereof.

Various embodiments can be configured to work in a network environment including the computer 84 that is in communication e.g., via a communications network with one or more devices. The computer 84 may communicate with the devices directly or indirectly, via any wired or wireless medium e.g. the Internet, LAN, WAN or Ethernet, Token Ring, a telephone line, a cable line, a radio channel, an optical communications line, commercial on-line service providers, bulletin board systems, a satellite communications link, a combination of any of the above. Any number and type of devices may be in communication with the computer.

In one embodiment, the present invention may be practiced on a network of one or more devices without a central authority. In such an embodiment, any functions described herein as performed by the server computer or data described as stored on the server computer may instead be performed by or stored on one or more such devices.

While the present invention is disclosed in terms of various specific embodiments, it can be appreciated that these embodiments are by way of example only. There are several variations contemplated by the present invention, and with the popularity of electronic gaming interfaces, the term "reel" should be broadly understood to include any set of images, defining a matrix, that are used to establish a payout. Accordingly, the scope of the invention is defined by the appended claims.

What is claimed is:

1. A gaming machine comprising:

a housing;

an interface supported by the housing;

a set of primary reels positioned in the interface and sharing a common axis, the set of primary reels having a first reel with a plurality of symbols including a first scatter symbol, the set of primary reels including a second reel with a plurality of symbols including a second scatter symbol;

a bonus reel positioned vertically above the set of primary reels on the interface and having an axis not aligned with the common axis of the primary reels, the bonus reel displays only integer values;

a first payline being defined between the first scatter symbol and a first integer value on the bonus reel, and a second payline being defined between the second scatter symbol and a second integer value on the bonus reel to enable the sum of the first integer value and the second integer value to determine the number of bonus games enabled by the first and second scatter symbols.

2. A gaming machine as set forth in claim 1, wherein a payline extends vertically on the interface.

3. A gaming machine as set forth in claim 1, wherein the bonus reel is a disk.

4. A gaming machine as set forth in claim 1, wherein the bonus reel is a belt.

5. A gaming machine as set forth in claim 1, wherein the bonus reel is an electronic image.

6. A gaming machine as set forth in claim 1, wherein the bonus reel rotates in a single direction.

7. A gaming machine as set forth in claim 1, wherein the interface includes an electronic display and the bonus reel and the set of primary reels are displayed electronically.

8. A gaming machine as set forth in claim 1, wherein symbols displayed by the set of primary reels include playing card symbols.

9. A gaming method for a gaming machine that is operated by at least one player and executes a game by displaying an image on a display, comprising:

providing a gaming machine housing to support the display, the gaming machine housing includes a computer mounted in the housing, the computer includes a main board having a memory connected to the main board for storing software, software stored in the memory for operating a display, and a processor for controlling the software;

displaying a set of primary reels on the display, the set of primary reels includes a first reel having a scatter symbol, and a second reel having a scatter symbol, rotating the set of primary reels about the common axis to display the first and second scatter symbols;

displaying a bonus reel vertically above the set of primary reels, the bonus reel having only integer values, each integer value corresponding to a primary reel;

rotating the bonus reel on an axis generally perpendicular to the common axis of the set of primary reels;

determining a first payline between the first scatter symbol on the set of primary reels and a corresponding integer value on the bonus reel, and determining a second payline between the second scatter symbol on the set of primary reels and a corresponding integer value on the bonus reel and summing the integer values to determine a payout of a number of bonus games.

10. A method as set forth in claim 9, wherein displaying the primary reels orients the common axis substantially horizontally across the interface and the set of primary reels define a matrix of rows parallel to the common axis and columns substantially perpendicular to the common axis.

11. A method as set forth in claim 10, wherein the bonus reel aligns above the set of primary reels to define the payline.

12. A method as set forth in claim 10, wherein displaying the bonus reel displays a matrix of at least one row and more than one column, the columns of the bonus reel matrix vertically align with the columns of the primary reels.

13. A method as set forth in claim 11, wherein displaying symbols includes displaying playing card symbols.

14. A gaming machine comprising:

a housing;

an interface supported by the housing;

a primary matrix positioned in the interface and having n rows and x columns, the primary matrix having a plurality of symbols, and at least one scatter symbol;

a bonus matrix fixed in the interface relative to the primary matrix, the bonus matrix having one row and x columns, the bonus matrix having only integer values, the bonus matrix integer values each being positioned vertically above the a corresponding symbol of the primary matrix on the interface; and a payline being defined between one of the columns of the bonus matrix and the at least one scatter symbol of the primary matrix, the payline determines a first payout, and the integer value of the bonus matrix in vertical alignment with the at least one scatter symbol of the primary matrix is a multiplier to establish a second payout.

15. A gaming machine as set forth in claim 14, wherein when more than one scatter symbol is displayed in the primary matrix then the sum of the integer values aligned with the displayed scatter symbols is used to establish the second payout in the form of bonus games.

* * * * *